United States Patent [19]

Kupferschmidt et al.

[11] Patent Number: 4,700,995

[45] Date of Patent: Oct. 20, 1987

[54] POLE MOUNTING CONNECTOR

[75] Inventors: Albert Kupferschmidt, Highland Park; Tracy D. Greene, Glenview; Donald F. Jaycox, Deerfield, all of Ill.

[73] Assignee: Northern Telecom Limited, Montreal, Canada

[21] Appl. No.: 844,306

[22] Filed: Mar. 26, 1986

[51] Int. Cl.[4] ..... H01R 11/00

[52] U.S. Cl. ..... 439/276; 439/142; 439/718; 439/573

[58] Field of Search ..... 339/36, 39, 44 R, 44 M, 339/125 R, 198 J, 198 N, 217 R, 263 R, 268 R, 242, 272 R, 272 A, 94 R, 94 M, 60 R, 60 M, 218 R, 218 M

[56] References Cited

U.S. PATENT DOCUMENTS

| | | | |
|---|---|---|---|
| 1,680,940 | 8/1928 | Emmons | 339/198 J |
| 3,742,427 | 6/1973 | Ballard | 339/60 M |
| 3,904,936 | 9/1975 | Hamrick, Jr. et al. | 339/198 J |
| 4,050,765 | 9/1977 | Duesterholft et al. | 339/60 M |
| 4,406,510 | 9/1983 | Debortoli et al. | 339/125 R |

FOREIGN PATENT DOCUMENTS

| | | | |
|---|---|---|---|
| 132968 | 4/1933 | Fed. Rep. of Germany | 339/198 J |

OTHER PUBLICATIONS

"Connector Block Assembly"; Cox; Western Electric Technical Digest No. 44, Oct. 1976.

*Primary Examiner*—Gil Weidenfeld
*Assistant Examiner*—Paula A. Austin
*Attorney, Agent, or Firm*—Schwartz, Jeffery, Schwaab, Mack, Blumenthal & Evans

[57] ABSTRACT

A connector has a rectangular box-like form body with end walls and side walls and a transverse wall dividing the body into front and back parts. The transverse wall extends from one end wall to the other but at the sides extends backwards a distance from the side walls and then extends laterally to the back ends of the side walls. This forms a central web portion having a channel along each side and a back chamber between the channels. Terminals are positioned in the central web portion. A stub cable enters through an end wall into the back chamber, the cable conductors connected to rear ends of the terminals. Drop wire conductors can enter through grommets to connect to the front ends of the terminals. A cover is pivotally mounted at one end of the body. The back chamber is filled with potting compound after connection of the cable conductors to the rear ends of the terminals.

12 Claims, 13 Drawing Figures

POLE MOUNTING CONNECTOR

This invention relates to a pole mounting connector and particularly to a connector by which wires to a customer's premises are connected to conductors of a stub cable which in turn is connected to a distribution cable.

Various types of connectors exist, often supported on a wire which extends with the distribution cable. Others are pole mounted adjacent to the distribution cable. A major problem of these connectors is providing a weatherproof enclosure for the conductors or wires, generally referred to as drop wires, which extend to a customer's premises. It is necessary for an installer, or maintenance worker, to have easy access to the terminals. At the same time, the connectors are positioned in exposed places. Ingress of water, dust, insects and other foreign matter can cause erosion of connectors and short circuits.

The present invention provides a connector which is molded as a single unit for the body part, with a separate cover or lid which seals the body. The body is divided into two parts, back and front. The stub cable conductors connect to the rear ends of terminals and the drop wire conductors connect to the front ends of terminals. After the stub cable conductors are connected to the terminals, the back part of the body is filled with a potting compound to seal the connectors.

Broadly, the invention provides a connector having a body member and a removable cover. The body member, of rectangular form, is divided into two parts, back and front, by a wall. Terminals are positioned in the wall, with stub cable connections to the rear ends of the terminals. Drop wire connections are made to the front ends of the terminals. Provision is made at one end for entry of a stub cable and access for the stub cable conductors to the back part of the body. Brackets for mounting straps are provided on the rear of the body and provision can be made for screws to pass through the rear of the body for attachment to a surface.

The invention will be readily understood by the following description of an embodiment, in conjunction with the accompanying drawings, in which.

Figure 5:
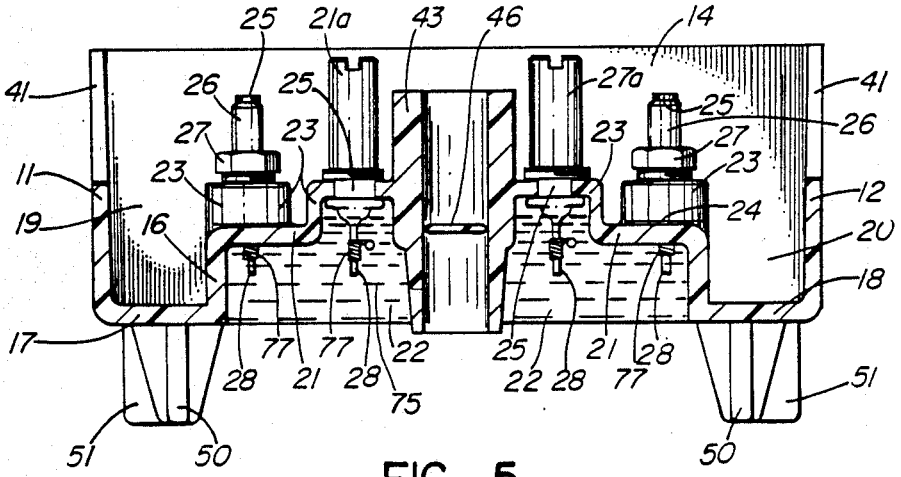
FIG. 5 is a transverse cross-section on the line V—V of FIG. 1.

As illustrated in the drawings, a connector body, indicated generally at 10, has parallel spaced side walls 11 and 12 and parallel spaced end walls 13 and 14 forming a rectangular body 15 which is a unitary molded structure. The body 15 is divided into front and back parts by a wall 16. Wall 16, at each side, unites with the back edges of the side walls 11 and 12, extending inwards for a short distance to define narrow back sections 17 and 18 (FIG. 5). The wall then extends forward for a short distance at each side, thus forming, with the side walls and the back sections 17 and 18, two channels 19 and 20. The wall then extends across to form a web 21. At the same time, a back chamber 22 is formed. A plurality of hollow bosses 23 are formed on the front surface 24 of the web 21. Each boss carries a terminal 25. The front end of each terminal is positioned in the front part of the body and is suited for connection of drop wire conductors, as by a threaded portion 26 and nuts 27. The back end of each terminal is in the back chamber 22 and is suited for connection of a conductor of a cable stub, for example being formed, at 28, for wire wrapping. The bosses 23 and the wall 16 are molded integral with the rest of the body. An alternative form of nut is indicated at **27*a*** which can be tightened by a screwdriver.

At one end, an aperture 30 is formed in the end wall, for example end wall 13. Extending outward from the end wall 13, around aperture 30, is a tubular extension 31. Through the extension 31 a cable stub can be inserted. The web 21 has an arcuate formation 32 which facilitates access for a cable end through aperture 30 into the back chamber 22. A ground terminal 33 is provided in the arcuate formation 32, having a ground member 34 which makes contact with the shield of the cable. The front end of the ground terminal extends into the front part and has means, such as nuts 35, for connection of a ground conductor.

Also in one end wall, in the example also wall 13, a number of apertures 36 are formed, communicating with the front part of the body. The apertures extend up to the front edge of the end wall, being open at the front edge. A grommet 37 (FIG. 7) is positioned in each aperture 36. The drop wires pass through the grommets 37 to the front ends of the terminals 25.

Figure 1:
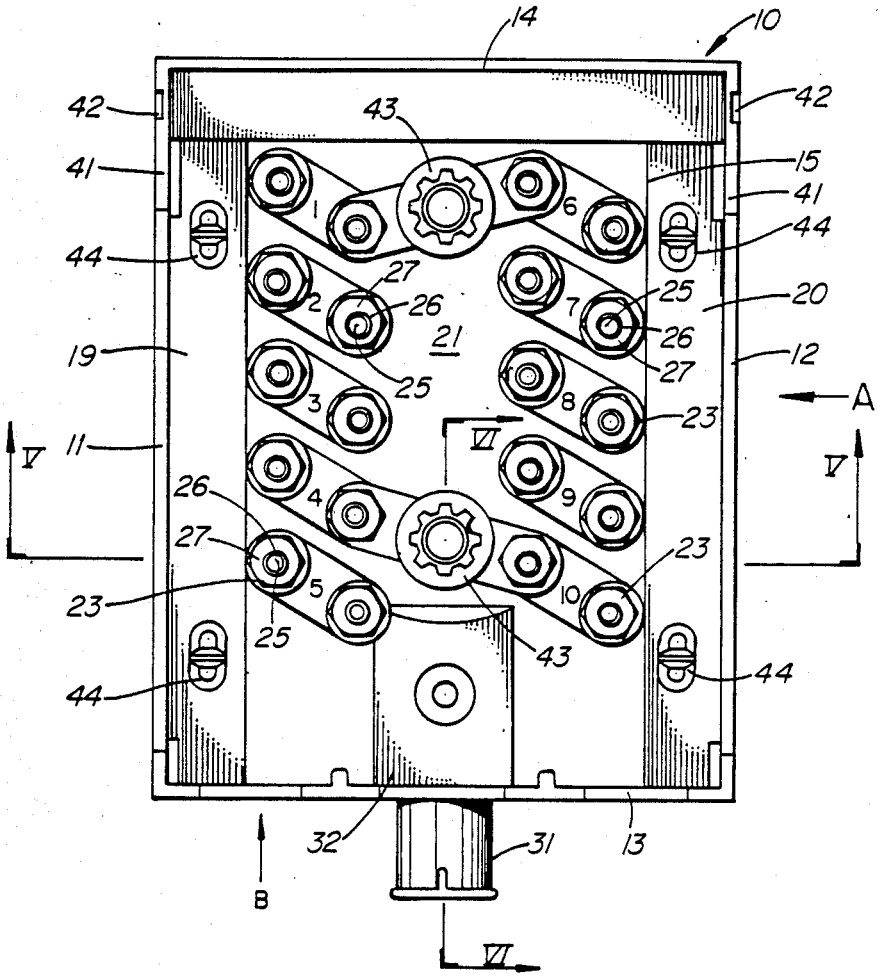
FIG. 1 is a front view of the connector body, with the cover removed.
Figure 2:
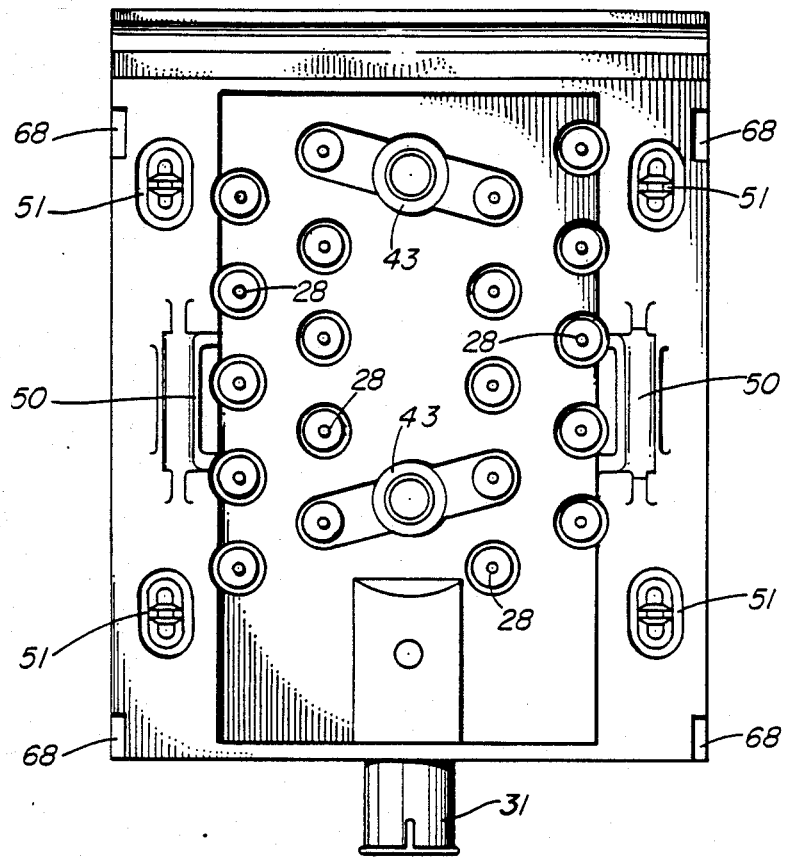
FIG. 2 is a back view, without potting compound.
Figure 3:
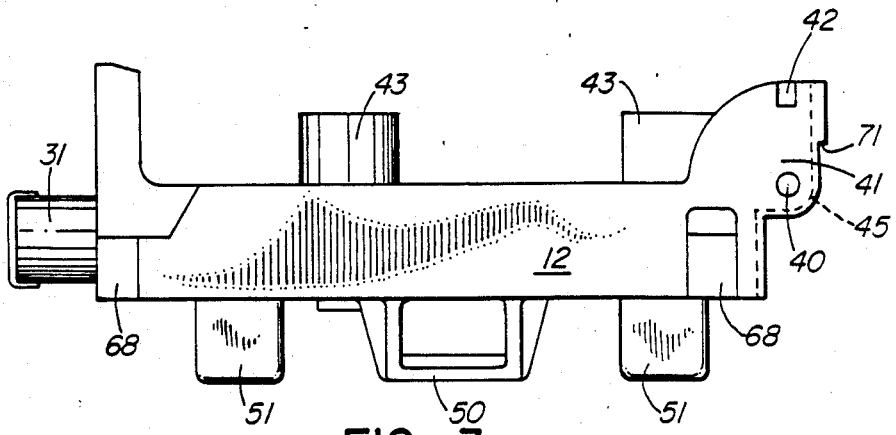
FIG. 3 is a side view in the direction of arrow A in FIG. 1.
Figure 4:
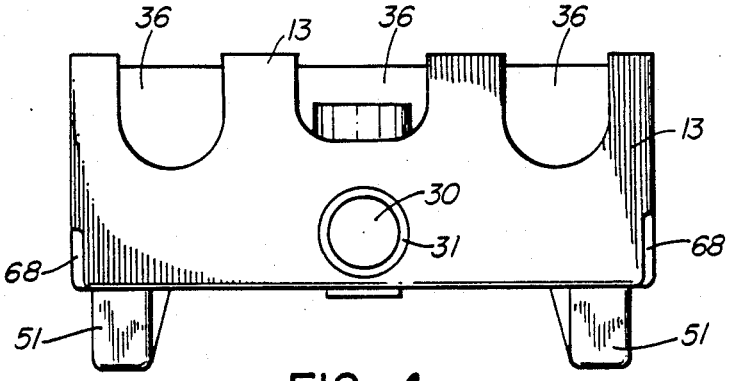
FIG. 4 is an end view in the direction of arrow B in FIG. 1.

The side walls 11 and 12, in the example, are reduced in height for a major part of their length between the end walls, providing easy access by installers to the terminals 25. At the end remote from the cable stub entry, at end wall 14, there is provided mounting means for a cover. This mounting means comprises bores 40 extending through webs 41 which are extensions of the side walls 11 and 12. The end wall 14 has a somewhat sinuous form, as indicated in dotted outline at 45 in FIG. 3, so as to extend up outside the webs 41. The webs 41 also each have an indent 42 at their peripheral edges for reception of a protrusion on the cover to hold the cover in an open position.

Also formed in the web 21 are two shallow bosses 43 through which bolts or screws can be passed to fasten the connector to a surface, such as pole, or a wall. Four small hollow bosses 44, two in each channel 19 and 20, provide positions through which screws or bolts can be pushed, for fastening the connector to a mounting surface. Bosses 43 and 44 have thin diaphragms molded in at the time of molding the body to close off bores through the bosses. The diaphragms can readily be pushed out, where necessary, when the particular mounting method has been determined, one diaphragm, in boss 43, being shown at 46 in FIG. 5.

On the back surface of the body, in the example on the back surfaces of the back sections 17 and 18 of the dividing wall 16, are formed brackets 50. These brackets provide for mounting of the connector on a pole by a strap passing through the brackets and round the pole. Also formed on the back surfaces of the sections 17 and 18 are hollow bosses 51. These bosses 51 are aligned with the bosses 44 and act to support the connector when the connector is mounted by screws or bolts through bosses 44, or through bosses 43.

Figure 6:
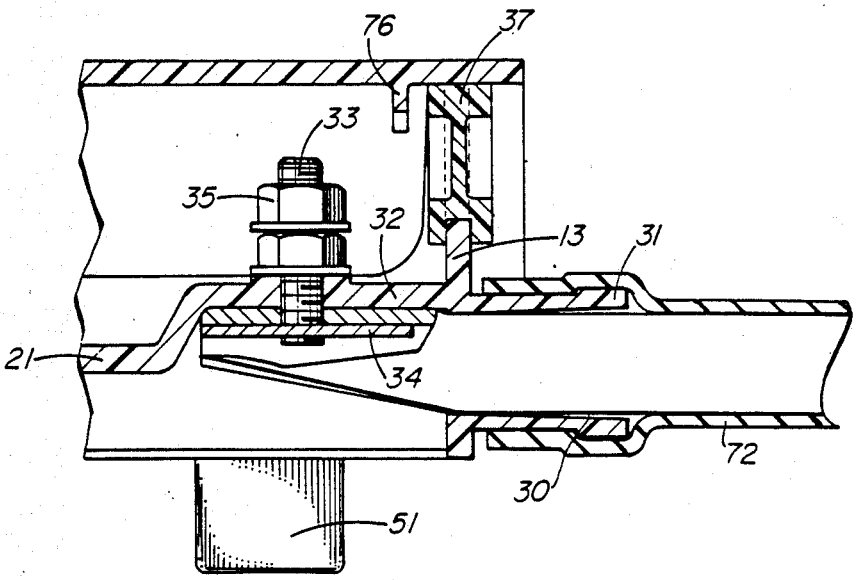
FIG. 6 is a cross-section on the line VI—VI of FIG. 1.
Figure 7:
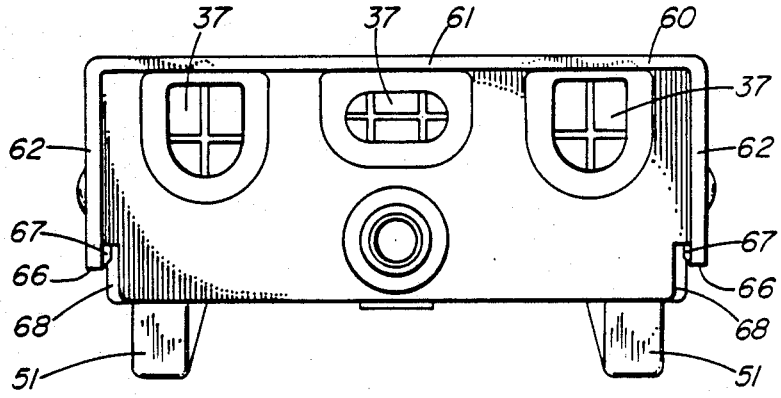
FIG. 7 is an end view as in FIG. 4, showing grommets in position, and also the cover.
Figure 8:
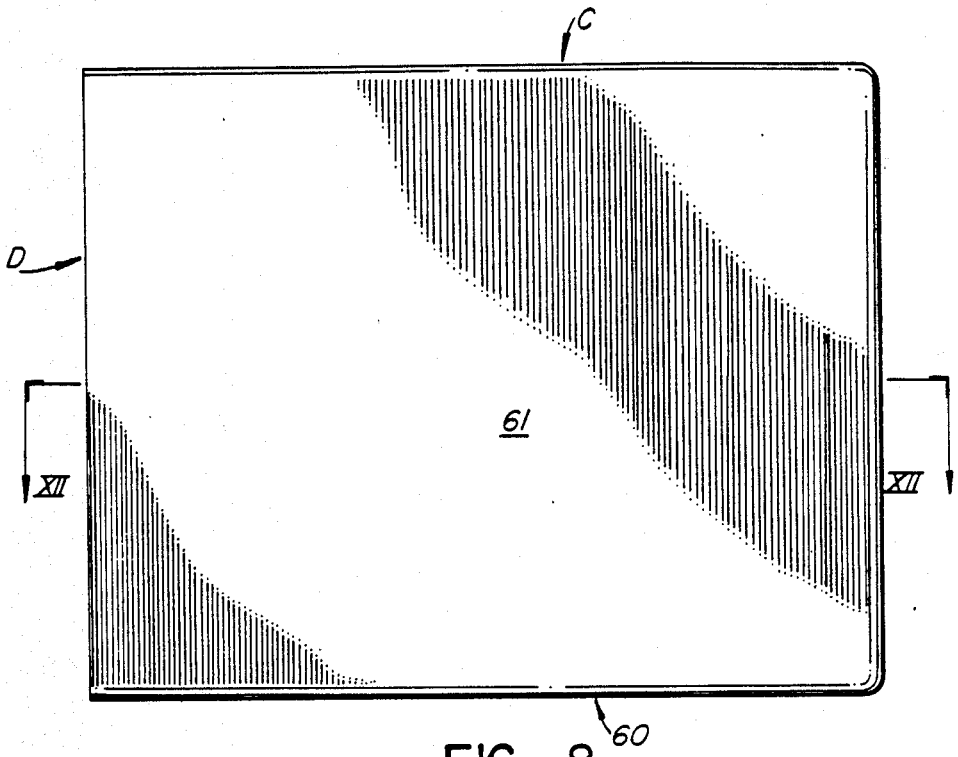
FIG. 8 is a front view of a cover.
Figure 9:
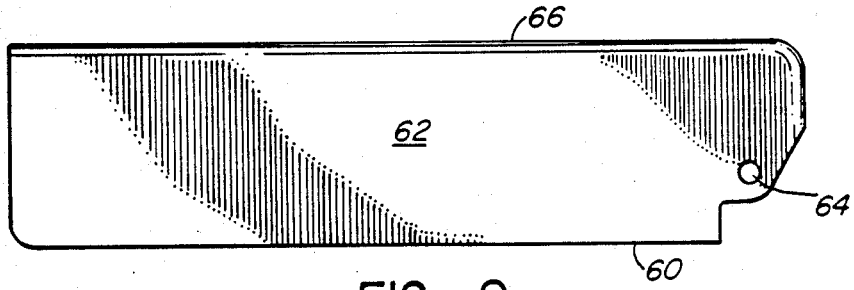
FIG. 9 is a side view of the cover in the direction of arrow C in FIG. 8.
Figure 10:
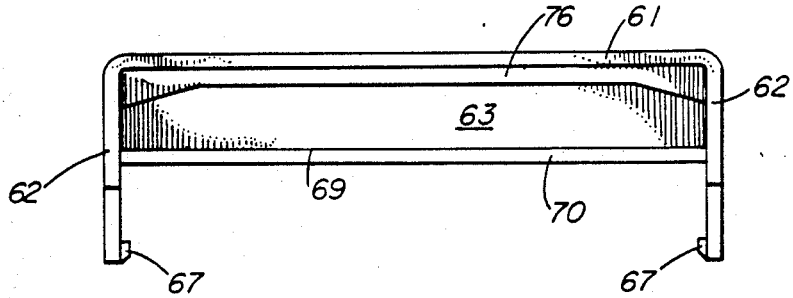
FIG. 10 is an end view in the direction of arrow D in FIG. 8.
Figure 11:
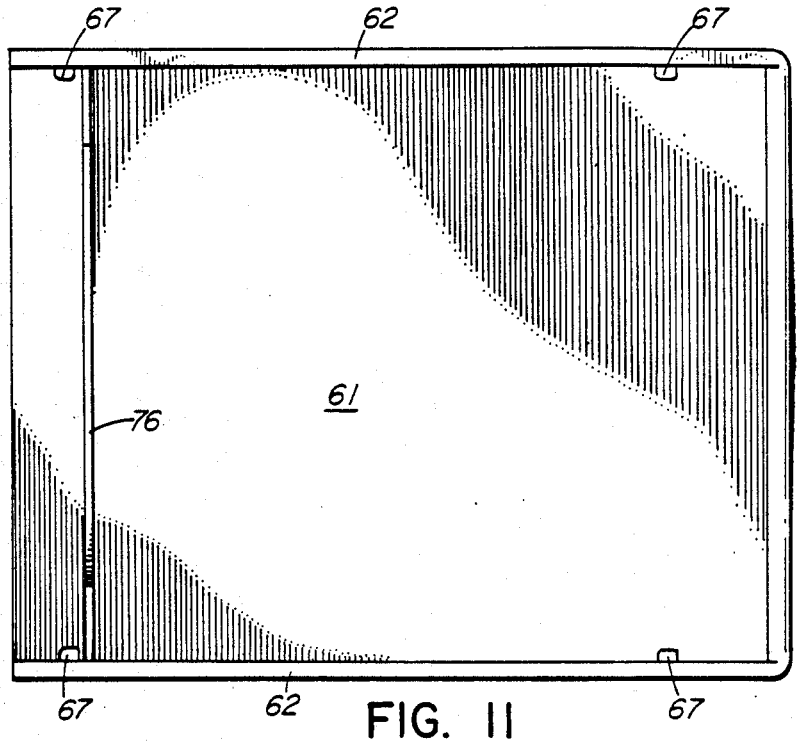
FIG. 11 is a back view of the cover.
Figure 12:
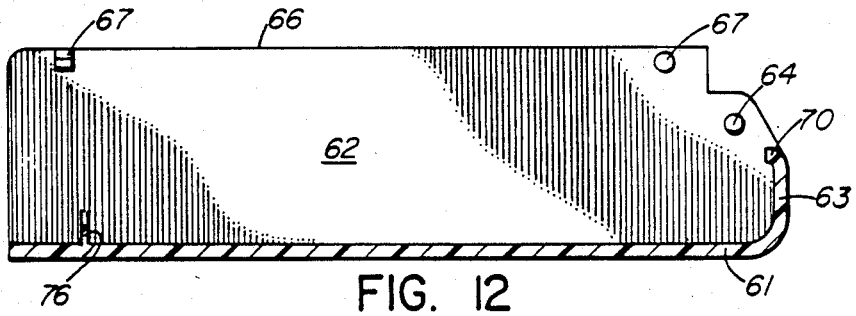
FIG. 12 is a cross-section on the line XII—XII of FIG. 8.

In FIGS. 1 to 5, the connector body only is seen, while in FIGS. 6 and 7 the cover 60 is shown in position. The cover is illustrated in more detail in FIGS. 8 to 12. FIG. 8 is an outer or front view, the cover being rectangular to meet the body 10. The cover has a front web 61 and parallel side walls 62. At one end is an end wall 63, this wall 63 extended to cooperate with end wall 14 of the body. A bore 64 in each side wal adjacent the end wall 63 is positioned to align with bores 40 in the webs 41 of the body 10. The cover pivots on pins positioned in the bores 40 and 64, a pin indicated at 65 in FIG. 13.

At each end of each side wall 62, adjacent to the rear edge 66, is an inwardly projecting rib or boss 67. These snap into recesses 68. Along the bottom or rear edge 69 of the wall 63 is an inwardly extending rib 70. Rib 70 engages under a step 71 on the end wall 14 of the body 10.

Figure 13:
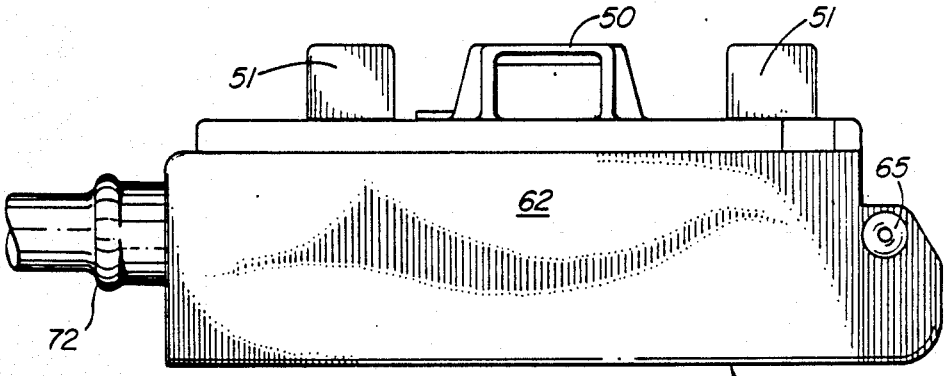
FIG. 13 is a side view, as in FIG. 3, showing the body and cover assembled.

Seen in FIGS. 6 and 13 is a sleeve 72 which fits over the tubular extension 31 on the body and over the end of a stub cable, not shown. In the cross-section illustration in FIG. 5, the back chamber 22 is shown filled with potting compound 75.

As can be appreciated from FIGS. 7 and 13, the side walls 62 of the cover extend down and over the side walls 11 and 12 of the body. The end 63 of the cover extends down over the end wall 14 of the body. At the end wall 13, the cover rests on the edge of the end wall, and a transverse rib 76 extends down inside the end wall 13, as seen in FIG. 6.

As illustrated in FIG. 5, the back chamber 22 is filled with potting compound, after connection of cable conductors 77 to the formations 28. This seals the back chamber against ingress of moisture, dust and the like.

What is claimed is:

1. A pole mounting connector for connection of drop-wire conductors to a distribution cable, said connector comprising a body member and a cover pivotally mounted on a side wall; said body member being of rectangular form having end walls and side walls and including a transverse wall extending across the body member and dividing the body member into two parts, a back part and a front part; said transverse wall having a center web portion extending between said end walls intermediate front and back edges of said end walls, a side portion extending along each side of said center web portion at a back edge of each side wall and intermediate portions uniting said center web portion and said side portions to define, with said side walls, a channel along each side of said center web portion; terminals positioned in said center web portion and having front ends in said front part and rear ends in a back chamber in said back part of said body member; means on said front ends of said terminals for connecting drop-wire conductors and means on said rear ends of said terminals for connecting conductors of a stub cable; entry means in one end wall for entry of a stub cable into said back chamber of said back part of said body member; mounting brackets on back surfaces of said side portions of said transverse wall; at least one aperture in said one end wall and communicating with said front part of said body member for entry of drop-wire conductors; said cover comprising a front web and parallel side walls, and pivotal mounting means at one end of each side wall of the cover; said pivotal mounting means on said cover engaged with said body member for pivotal mounting of said cover on said body member.

2. A connector as claimed in claim 1, said side walls of said cover overlapping said side walls of said body member.

3. A connector as claimed in claim 1, said center web portion having an arcuate formation adjacent said one end wall, said formation forming an arcuate recess in a back surface for accommodation of said stub cable, and a ground terminal extending through said arcuate formation, said ground terminal having a rear end for attachment to a metal shield on said stub cable.

4. A connector as claimed in claim 1, said mounting brackets comprising two brackets positioned one on each said back surface of a side portion at a position intermediate the ends of said connector, and including a hollow boss at each end of each said side portion on said back surfaces thereof for passage of fastening means therethrough for attachment of said connector to a support surface.

5. A connector as claimed in claim 1, said entry means in said one end wall comprising a tubular extension extending outwardly from said end wall, and said at least one aperture in said one end wall extending up to a front edge of the end wall, and a grommet in said aperture for sealing around said drop-wire conductors.

6. A connector as claimed in claim 1, including a stub cable entered through said entry means in said one end wall, conductors of said stub cable being connected to said rear ends of said terminals, and said back chamber filled with a potting compound.

7. A connector as claimed in claim 1, including a plurality of hollow bosses on said center web portion, said bosses extending into said front part of said body member, said terminals mounted in said bosses.

8. A connector as claimed in claim 7, said bosses each having a front surface, said front surfaces of said bosses extending in a common plane.

9. A connector as claimed in claim 8, said side walls of said body member having front edges extending approximately in said common plane.

10. A connector as claimed in claim 7, said bosses forming four rows extending parallel to the side walls of the body member.

11. A connector as claimed in claim 10, said rows arranged in pairs, one pair of rows on one side of a central axis and the other pair on the other side of the central axis.

12. A connector as claimed in claim 11, including two further hollow bosses on said center web portion and positioned between said pairs of rows and spaced apart in a direction parallel to said side walls of the body member, said further bosses providing means for passing fastening members for attaching the connector to a support member.

* * * * *